United States Patent [19]

Kahl et al.

[11] Patent Number: 5,024,471

[45] Date of Patent: Jun. 18, 1991

[54] SAFETY RELEASE LATCH

[75] Inventors: W. Henry Kahl, Wooster, Ohio; David E. Price, Winfield; Nai-Cheng Tsao, Arkansas City, both of Kans.

[73] Assignee: Rubbermaid Incorporated, Wooster, Ohio

[21] Appl. No.: 557,965

[22] Filed: Jul. 25, 1990

[51] Int. Cl.[5] ..... E05C 3/14

[52] U.S. Cl. ..... 292/97; 292/113; 292/DIG. 38; 292/DIG. 49; 220/315

[58] Field of Search ..... 292/DIG. 42, DIG. 38, 292/DIG. 49, 97, 100, 113, 247; 220/315, 322

[56] References Cited

U.S. PATENT DOCUMENTS

| | | | |
|---|---|---|---|
| 2,812,204 | 2/1955 | Squire | 292/DIG. 38 |
| 3,606,511 | 9/1971 | Henning et al. | 312/266 |
| 3,672,403 | 6/1972 | Wilson et al. | 220/315 |
| 3,690,708 | 9/1972 | Worley et al. | 292/DIG. 38 |
| 3,700,301 | 10/1972 | Boeck | 312/333 |
| 3,709,538 | 1/1973 | Seitz et al. | 292/DIG. 38 |
| 3,713,681 | 1/1973 | Worley | 292/78 |
| 3,730,576 | 5/1973 | Schurman | 292/DIG. 38 |
| 3,822,905 | 7/1974 | Bell | 292/DIG. 38 |
| 4,232,890 | 11/1980 | Hoen | 292/DIG. 38 |
| 4,244,612 | 1/1981 | Schurman | 292/DIG. 38 |
| 4,249,760 | 2/1981 | Conley | 292/197 |
| 4,262,607 | 4/1981 | Krebs | 220/315 |
| 4,502,715 | 3/1985 | Lundblade | 292/78 |
| 4,691,840 | 9/1987 | Ferbrache | 220/318 |

*Primary Examiner*—Eric K. Nicholson
*Assistant Examiner*—Darnell M. Boucher
*Attorney, Agent, or Firm*—Renner, Kenner, Greive, Bobak, Taylor & Weber

[57] ABSTRACT

A latch assembly (12) is adapted for use with a container having a base portion (11) and a cover (10) affixable thereto by the latch assembly (12). The base portion (11) has projections (17) extending from its sidewall and the cover (10) has lugs (14) extending therefrom. A latch plate (19) has laterally spaced ribs (25) between which an upper lever bar (28) is pivotally connected to define an upper pivot point. Ribs (45) on the upper lever bar (28) are adapted to snap over the lugs (14) to attach the latch assembly (12) to the cover (10). The lower end of a lower lever bar (30) is also pivotally connected between the ribs (25) to define a lower pivot point. The upper edge of the lower lever bar (30) is hinge connected (33, 34) to the lower edge of the upper lever bar (28) with the centerline of the hinge (33, 34) being laterally offset from a plane defining both the upper and lower pivot points. The bottom of the latch plate (19) is adapted to releasably engage the projections (17) extending from the base portion (11) to latch the cover (10) thereto. As the latch plate (19) is swung to and from the latched and unlatched position, the hinge (33, 34) swings over center with respect to the plane of the upper and lower pivot points.

10 Claims, 5 Drawing Sheets

SAFETY RELEASE LATCH

TECHNICAL FIELD

The invention relates to latches for the lids or covers of large containers, such as portable containers for transporting food, ice and beverages to picnics and the like. More particularly, this invention relates to such a latch which is easy to assemble and reliable in nature, and which is provided with a safety override feature whereby the cover can be opened by pressure applied from within should, for example, a small child be trapped in the container.

BACKGROUND ART

Almost every container which has a cover hingedly attached thereto is provided with some type of latch mechanism to secure the cover to the container. The complexity and other needs of such latch mechanisms are, in part, dependent upon the amount of security desired. Where a container is rather large, for example, of a size that a small child could get into the container and have it accidentally latched from the outside, it is desirable that the latch be provided with a safety override feature such that the entrapped child could release the latch by applying upward pressure to the cover from within the container.

Certain prior latches for containers of this kind have had complicated mechanisms and have required springs to apply tension to hold the latch in a latched or unlatched position. Some prior constructions have also required a movable element to position the latch in its latched or unlatched positions. The present improved latch assembly is in itself utilized as a handle to move the latch to open and closed positions. Moreover, most prior safety latches are difficult to install or assemble, requiring the need for mechanical fasteners or the like.

One such safety latch is shown in U.S. Pat. No. 4,502,715 wherein the latch assembly is mounted within a recess in the container cover by pivots on a bracket detachably secured within the recess. The mounting operation is not only awkward but requires mechanical fasteners. Moreover, when mounted, a portion of the latch handle projects outwardly from the sides of the container where it can be accidentally bumped or struck to open the cover. In addition, the camming action required to latch or unlatch the mechanism promotes the wearing of parts having high tolerance requirements thereby resulting in an early failure of the latch.

DISCLOSURE OF THE INVENTION

It is thus a primary object of the present invention to provide an assembly for latching a cover to a container which includes a safety override feature such that by pushing upwardly on the cover with the latch assembly in a latched position, the latch may be released.

It is another object of the present invention to provide a latch assembly, as above, which is easily assembled by being snapped onto a container cover into operating position without the aid of any tools or mechanical fasteners.

It is an additional object of the present invention to provide a latch assembly, as above, in which all of the parts are constructed of resilient plastic material.

These and other objects of the present invention, as well as the advantages thereof over existing prior art forms, which will become apparent from the description to follow, are accomplished by the improvements hereinafter described and claimed.

In general, the latch assembly according to the concept of the present invention is adapted for use with a container having projections extending from a sidewall of a body portion and a cover abutting the top of the body portion and having lugs projecting outwardly therefrom. The latch assembly includes a latch plate having laterally spaced ribs between which an upper lever bar is pivotally attached to define an upper pivot point. Means are provided on the upper lever bar to attach the same to the cover by snapping over the lugs projecting therefrom. The lower end of a lower lever bar is also pivotally attached between the ribs of the latch plate to define a lower pivot point. The upper edge of the lower lever bar is hinge connected to the lower edge of the upper bar with the centerline of the hinge being laterally offset from a plane defining both the upper and lower pivot points. Means are provided at the bottom of the latch plate for releasably engaging the projections extending from the base portion for latching the cover thereto. As the latch plate is swung to and from the latched and unlatched position, the hinge swings over center with respect to the plane of the upper and lower pivot points.

A preferred exemplary latch mechanism incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
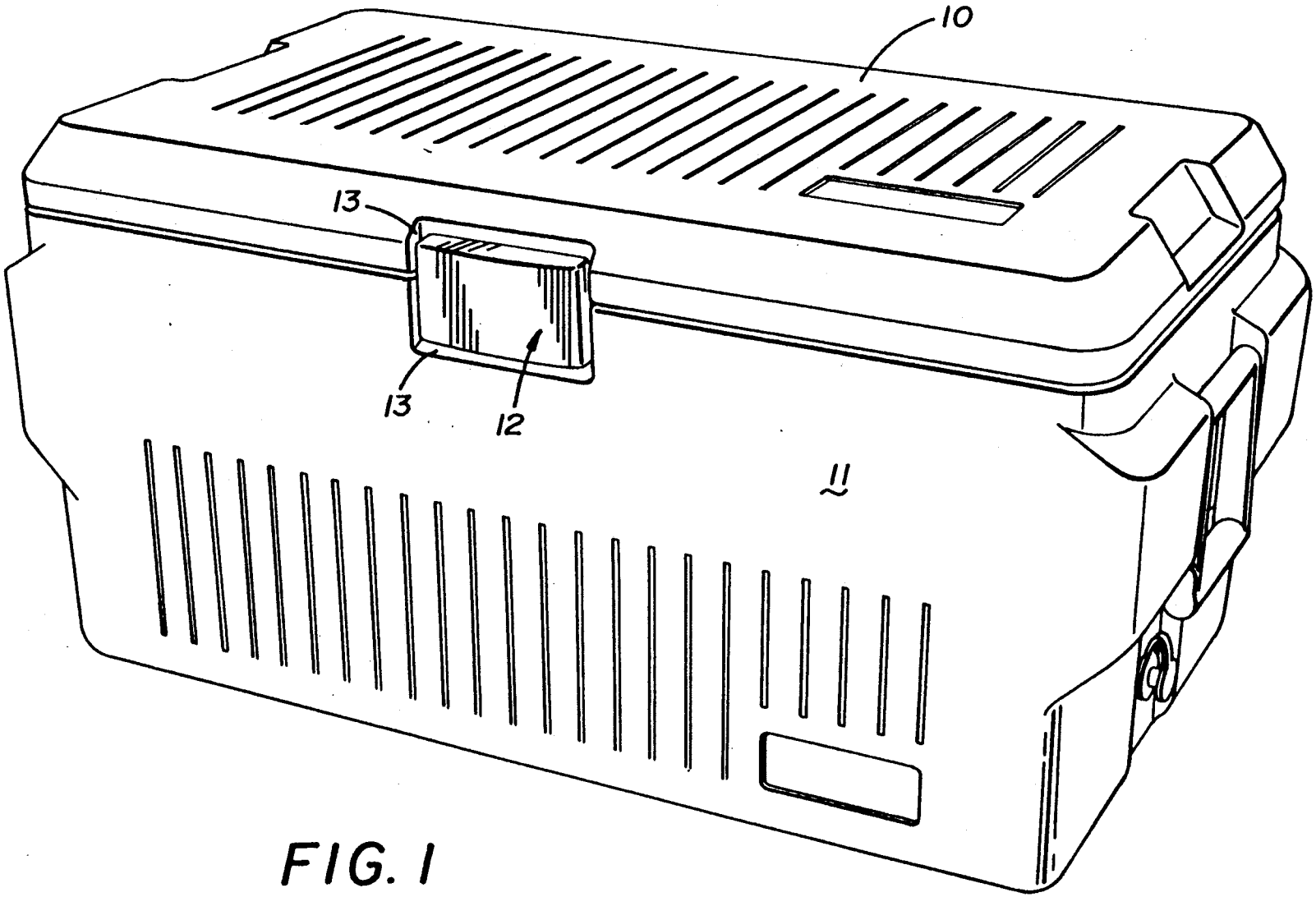
FIG. 1 is a perspective view of a large container such as may be used as an ice chest or a food and beverage container, showing the cover and the latch assembly according to the present invention in closed position.

FIG. 1 shows a relatively large container having a top lid or cover 10 enclosing a body portion 11. The improved latch assembly, indicated generally by the numeral 12, spans the joint between body portion 11 and cover 10 and is positioned within a recess 13 on one side of the body portion 11 and cover 10. Cover 10 is preferably hinged (not shown) to the container body 11 on the opposite side from latch assembly 12. As also shown in FIG. 1, cover 10 and base portion 11 are provided with other conventional members, such as handles, spigots and the like, and are also provided with other adornments which play no part in the present invention and which are thus not described herein.

Figure 2:
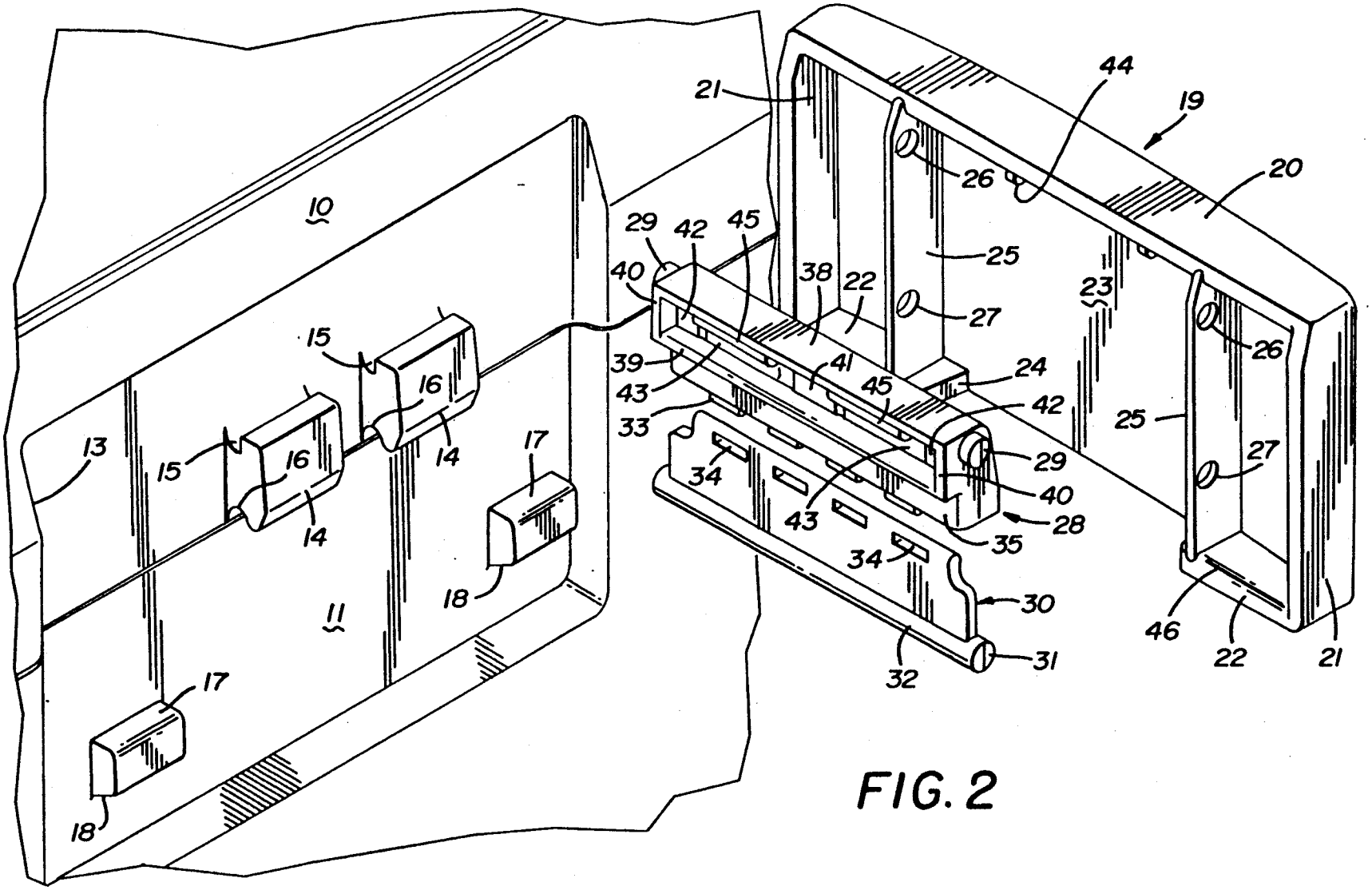
FIG. 2 is an enlarged exploded perspective view of the parts of the latch assembly, and fragmentarily showing those parts of the cover and the container wall with which the latch is engageable.

As seen in FIG. 2, within recess 13 the cover 10 has two outwardly projecting laterally spaced rectangular lugs 14 having inner horizontal rounded grooves 15 and 16 in their top and bottom surfaces, respectively. Body portion 11 has two laterally spaced projections 17 having inclined bottom surfaces 18. The purposes of lugs 14 and projections 17 will be hereinafter described in detail.

Figure 3:
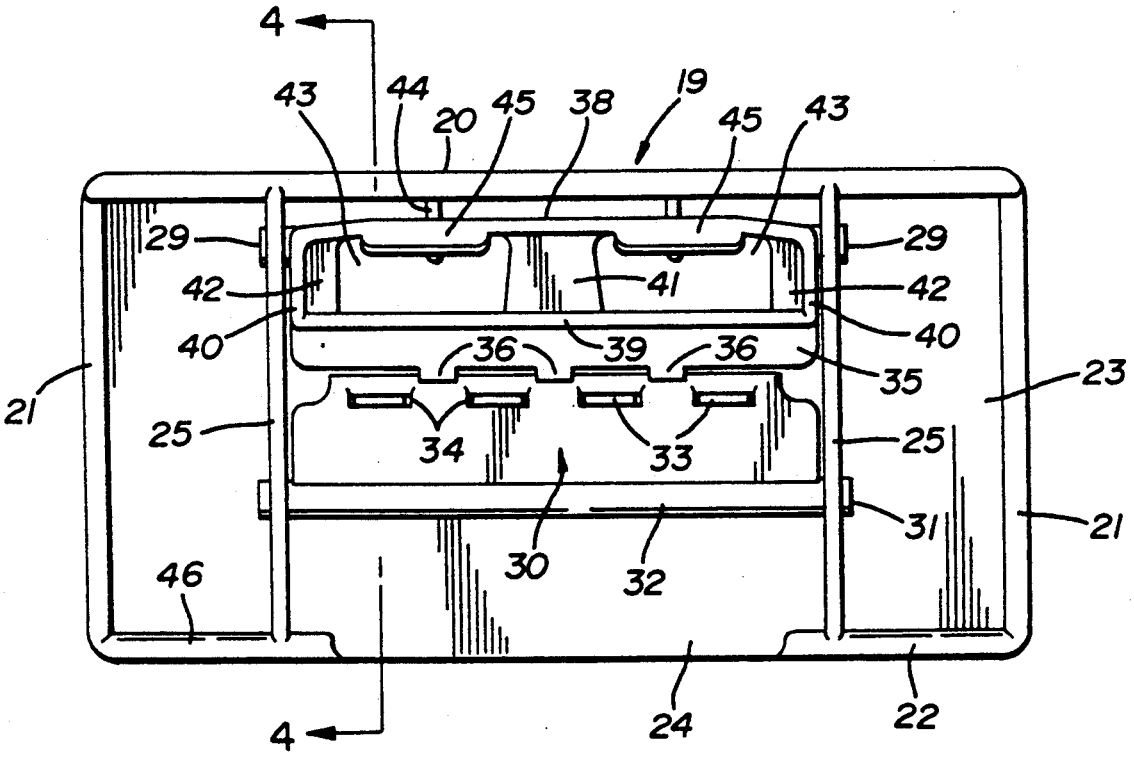
FIG. 3 is an interior elevation view of the latch assembly detached from the container.

The improved latch assembly 12 is shown detached from the container in FIG. 3 and in exploded form in FIG. 2. Latch assembly 12 includes a rectangular outer latch plate indicated generally by the numeral 19 and having a top flange 20, side flanges 21 and bottom flanges 22 all interconnected by an outer plate 23. The inner ends of flanges 22 are spaced apart forming a central slot 24 along the bottom portion of latch plate 19. Slot 24 allows insertion of one's fingers when the latch is closed in order to pull the latch outward to the open position shown in FIG. 5. As shown in FIGS. 2 and 3, latch plate 19 also includes two vertical ribs 25 extending between top flange 20 and flange 22 substantially at the ends of slot 24. Ribs 25 are provided with horizontally aligned upper holes 26 therein and horizontally aligned lower holes 27 therein.

Latch assembly 12 also includes an upper transverse bar, indicated generally by the numeral 28, which is pivotally mounted in holes 26 by means of stub end shafts 29 positionable in holes 26. Latch assembly 12 also includes a lower transverse bar, indicated generally by the numeral 30 which is pivotally mounted in holes 27 by swiveling the ends 31 of its shaft portion 32 in holes 27.

Bars 28 and 30 are hinged together by means of laterally spaced curved hooks 33 depending from upper bar 28 and slidably extendable through laterally spaced slots 34 in the upper part of lower bar 30 to form a pivotal or hinge connection therewith. The lower part 35 of upper bar 28 is rounded and is provided with laterally spaced protuberances 36 (FIG. 3) adapted to be in abutment with the upper edge of lower bar 30 to insure a tight fit between bars 28 and 30 in all positions thereof.

The upper part of upper bar 28 is shown as being in the form of a rectangular frame defined by upper and lower flanges 38 and 39, respectively, and side flanges 40. A medial strut 41 and end struts 42 extending between upper and lower flanges 38 and 39 define laterally spaced rectangular slots 43 within the frame. Slots 43 are designed to receive the lugs 14 on the cover 10 when the latch is in both the closed and open positions of FIGS. 4 and 5. When upper bar 28 is positioned within latch plate 19, as by positioning shafts 29 in holes 26, as previously described, the edge of upper flange 38 will engage a pair of small ribs 44 which extend inwardly from plate 23 of latch plate 19 at a point just below top flange 20 thereof. Ribs 44 not only assure the positive location of upper bar 28 during assembly, but also they provide medial support to the edge of upper flange 38.

Top flange 38 of upper bar 28 has spaced rounded ribs 45 depending therefrom and extending over slots 43. Ribs 45 are adapted to rotatably engage grooves 15 in lugs 14 on the cover. Lower flange 39 of bar 28 is also rounded and adapted to rotatably engage grooves 16 in lugs 14 as seen in FIGS. 4 and 5.

Latch assembly 12 is quickly and easily attached to cover 10 without the use of any tools by first positioning rounded lower flange 39 in grooves 16 of lugs 14. Then by pulling outwardly and upwardly on latch plate 19, upper flange 38 will ride along the outermost surface of lugs 14 and latch plate 19 will pivot counterclockwise about the axis defined by the center of the radius of grooves 16. Continued pressure will cause the rounded upper flange 38 and the ribs 45 to bend outwardly and then snap into engagement with the grooves 15 in lugs 14.

Figure 4:
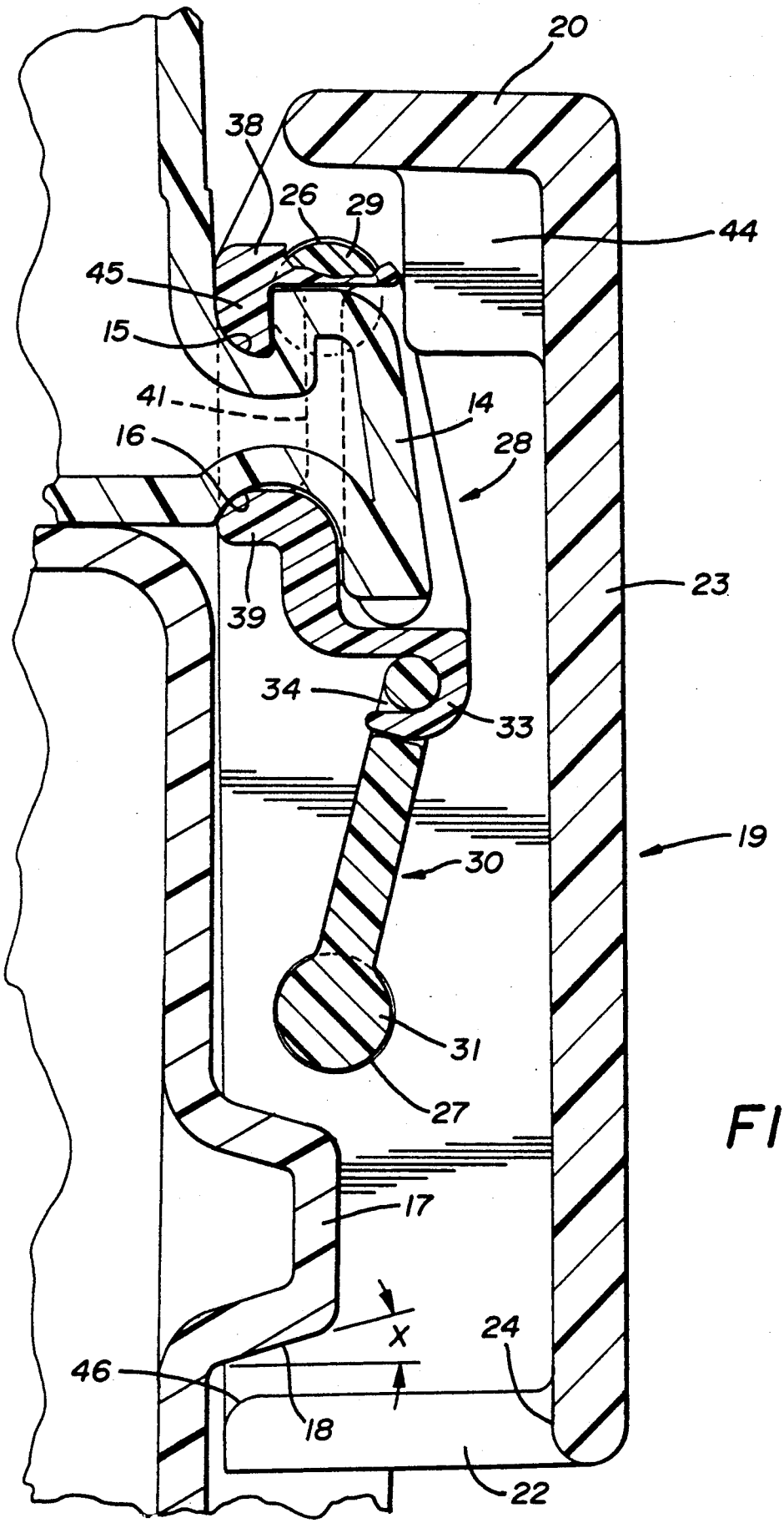
FIG. 4 is an enlarged fragmentary cross-sectional view on line 4—4 of FIG. 3 showing the latch assembly engaged with the cover and in the closed position.

When the latch is in the closed position shown in FIG. 4, the lever bars 28 and 30, together with the hinge connection 33, 34, constitute a linkage between pivot axes defined by holes 26 and 27 in the ribs 25. In this position the hinge 33, 34 is to the right of or over center with respect to a plane or line between the pivots defined by holes 26 and 27. All component parts of latch 12 are preferably made of resilient plastic material, such as copolymer polyethylene, and thus the resilience of bars 28 and 30 allows the linkage to swing over center and holds them firmly in either the open or closed position.

Figure 5:
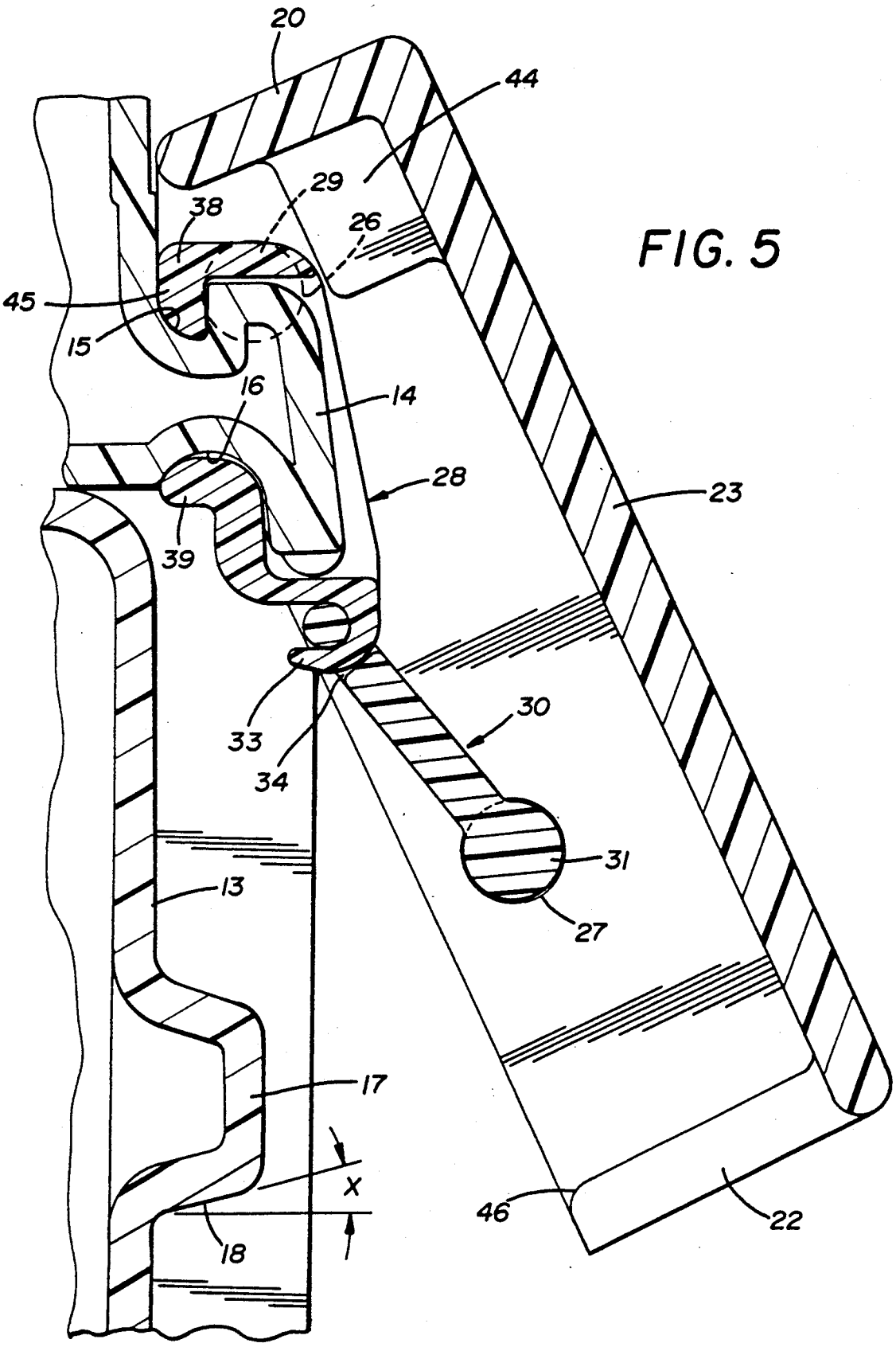
FIG. 5 is a view similar to FIG. 4 showing the latch assembly in an open position freeing the cover for movement upwardly from the container.

When the latch is firmly pulled outwardly with one's fingers inserted into the slot 24, the resilience of the plastic parts allows the ends 31 of shaft 32 to swing to the right to the open position of FIG. 5 as the hinge 33, 34 swings over center with respect to the pivots defined by holes 26 and 27. In this position the cover and attached latch may be lifted from the container.

The improved latch assembly is entirely self-contained and enclosed within the outer latch plate 19, and in the closed position of FIG. 4 within the recess 13. Thus, there are no projecting parts to be bumped or struck to be damaged or to accidentally open the container.

If a child were to enter the container and be accidentally entrapped therein by someone unknowingly closing the latch to the FIG. 4 position, the natural tendency of the child would be to push upwardly on the cover. Latch assembly 12 is provided with an override feature so that a small child who would be able to apply an upward pressure of about 15 pounds will cause the bottom flanges 22 of the latch plate 19 to slidably engage and cam upwardly over the inclined lower surfaces 18 of the projections 17 on the container body. To assist in this action, the edge of bottom flange 22 can be provided with a radius 46 best shown in FIGS. 4 and 5. The angle x of surfaces 18 with the horizontal may vary between 15°-20° depending on the size of the container and the specific material of the latch assembly 12. Also, the projections 17 extend outwardly from the body a distance such that the hinge will snap over center before the radiused edge 46 of the bottom of flanges 22 disengage from the inclined surfaces 18 and thus release the latch. A preferred outward extent of projection 17 is about 0.375 inches.

We claim:

1. In combination with a container having a base portion and a cover abutting the top thereof, the base portion having laterally spaced outward extending projections on a sidewall, a latch assembly comprising:

a latch plate having laterally spaced vertical ribs;

a transverse upper lever bar having upper and lower edges and outer ends where a portion of its upper outer ends are pivoted on said ribs thereby defining an upper pivot;

means on said upper lever bar for attachment to said cover;

a transverse lower lever bar having upper and lower edges and outer ends where a portion of its lower outer ends are pivoted on said ribs thereby defining a lower pivot, said lower lever bar also having an upper horizontal edge hinge connected to the lower edge of said upper lever bar, the centerline of said hinge being laterally offset from a plane defining both said upper and lower pivots;

means on the bottom of said latch plate for releasably engaging said projections on the base portion for latching the cover thereto;

said hinge being adapted to swing over center with respect to the plane of said upper and lower pivots as the latch plate is swung to and from the latched and unlatched position.

2. The combination of claim 1, wherein all of the parts of the latch assembly are made of resilient plastic material.

3. The combination of claim 1, wherein the cover has projecting lugs with upper and lower grooves therein, and said upper lever bar having upper ribs and a lower flange adapted to resiliently snap into said upper and lower grooves, respectively, when said latch plate is pulled outwardly and upwardly to swing said hinge over center with respect to the plane defining said upper and lower pivots.

4. The combination of claim 3, wherein the hinge between said upper and lower lever bars includes curved hooks depending from said upper bar and extending slidably through curved slots in the upper edge portion of said lower bar.

5. The combination of claim 1, wherein the projections on the base portion include a surface angled in the range of 15° to 20° from horizontal.

6. The combination of claim 5, wherein said means on the bottom of said latch plate includes a radiused surface to engage said angled surface.

7. In combination with a container having a base portion and a top cover, the base portion having projections extending therefrom and the cover having projecting lugs, a latch assembly comprising:

a latch plate;

a linkage having upper and lower lever bars pivotally hinged together; means for pivoting the upper and lower lever bars on said latch plate at their outer edges, said hinge being laterally offset with respect to a line between the upper and lower pivots;

said upper lever bar having resilient ribs adapted to snap into attachment with the projecting lugs, and said latch plate having a bottom flange adapted to engage the projections extending from the base portion in the latched position;

and said hinge adapted to swing over center with respect to a line between said upper and lower pivots when said latch plate is swung to and from latched and unlatched positions.

8. The combination of claim 7, wherein the projections extending from the base portion have inclined bottom surfaces adapted, when said cover is pushed upwardly with the latch plate in closed position, to slidably engage and cause the bottom flange of the latch plate to cam thereover, thereby swinging the latch plate to the unlatched position.

9. The combination of claim 8, wherein the inclined bottom surfaces are angled in the range of 15° to 20° from the horizontal.

10. The combination of claim 8, wherein said bottom flange of said latch plate has a radiused surface to engage said inclined bottom surfaces of the projections.

* * * * *